United States Patent [19]

Ando

[11] 4,337,928

[45] Jul. 6, 1982

[54] APPARATUS FOR CHANGING THE CHARGE DISTRIBUTION IN A BLAST FURNACE

[75] Inventor: Kyoichi Ando, Kitakyushu, Japan

[73] Assignees: Nippon Steel Corporation, Tokyo; Nittetsu Plant Designing Corporation, Kitakyushu, both of Japan

[21] Appl. No.: 145,456

[22] Filed: Apr. 25, 1980

[30] Foreign Application Priority Data

May 2, 1979 [JP] Japan ..... 54-58227

[51] Int. Cl.[3] ..... C21B 7/00

[52] U.S. Cl. ..... 266/197; 266/233

[58] Field of Search ..... 266/197, 233

[56] References Cited

U.S. PATENT DOCUMENTS 4,122,296 10/1978 Hummler ..... 266/233

*Primary Examiner*—Peter D. Rosenberg

*Attorney, Agent, or Firm*—Wenderoth, Lind & Ponack

[57] ABSTRACT

An apparatus for changing the charge distribution in a blast furnace is constituted by a large number of arms disposed in a circle in the top of the furnace, the upper end of each arm being attached to the shell of the furnace through a link so as to be tiltable relative to the shell, a plate fixed to the lower portion of the arm and facing toward the center of the furnace, and a mechanism including a push rod for inclining the arm with respect to the axis of the furnace in a direction for pushing the lower portion of the arm toward the furnace center. The link, arm and push rod make up a link mechanism. The linear motion of the push rod expands the paired link and arm and inclines the plate while pushing the plate inward.

4 Claims, 5 Drawing Figures

APPARATUS FOR CHANGING THE CHARGE DISTRIBUTION IN A BLAST FURNACE

BACKGROUND OF THE INVENTION AND PRIOR ART

This invention relates to an apparatus for changing the charge distribution in a blast furnace, and more particularly to an apparatus which changes the blast furnace charge distribution by moving a large number of plates disposed in a circle in the top portion of the blast furnace top for changing the inclination thereof with respect to the central vertical axis of the furnace.

A conventional apparatus for changing the blast furnace charge distribution, known as a tilting type apparatus, comprises a large number of arms each carrying a plate of a tough material, such as armor plate, fixed to the lower portion thereof and disposed in a circle within the top of the blast furnace, the upper end of each arm being hinged to the furnace shell so that the arm is pivotable with respect to the shell. The furnace charge, comprising iron ore, coke and so on, from a large bell, falls against the plates and is deflected thereby and then drops into the furnace. The position to which the charge falls in the furnace can be adjusted by changing the position and inclination of the plates.

FIGS. 1 and 2 show an example of such a conventional blast furnace charge distribution apparatus. A large number of arms 9 are pivotally suspended in a circle in the top of a furnace shell, each arm being pivotably mounted on the shell by a metal hanger 8 at a point above a gas uptake 2. A plate 10 is fixed to the lower portion of each arm 9. A driving ring 11 encircles the shell 1 at substantially the same level as the plates 10 and is movably mounted for movement around the shell. The driving ring 11 drives a plurality of crank levers 12, one for each arm 9. One end of each crank lever 12 is connected to the driving ring for being rotated thereby, and the other end thereof is pivotally connected to the rear end of a horizontal push rod 13 passing through the furnace shell. The foremost end of the horizontal push rod is connected to the lower part of the corresponding arm 9. The driving ring 11 also has connected thereto a hydraulic piston-cylinder mechanism 14 which moves the ring 11 around the shell. When the hydraulic cylinder 14 moves the driving ring 11 around the furnace shell 1, all the crank levers 12 rotate about their vertical axes at the same time. As a consequence, the horizontal push rods 13, connected to the crank levers 12, move back and forth to change the position and inclination of the plates 10. When the plates 10 are placed in an appropriate position, the charge falls along the bell 4 and along trajectory 5, striking plates 10 and then falling along trajectory 6 to the desired position 7 in the furnace.

The conventional apparatus of this type has the arms 9 suspended from a very high part of the furnace shell 1, so that the plates 10 are inclined only slightly even when pushed inward as far as they will go and, therefore, and unable to deflect the charge to the center of the furnace. Further, because the plates are exposed to a rapid stream of gas, the plates 10 wear down quickly. The great length of the arms 9 and the large size of the plates 10 make their replacement difficult. The vertical and horizontal movement of the horizontal push rod 13 during operation prevents perfect gas sealing, which leads to a heavy inflow of dust into the casing 15 of the push rod drive means. In addition, the presence of the driving ring 11, crank levers 12, hydraulic cylinder 14, etc. outside the furnace shell 1 presents considerable danger to the operators.

Other examples of a tilting type charge distribution changing apparatus are found in Belgium Pat. No. 672,912 and German Pat. No. 625,591. They are also unable to change the position and inclination of the plates to any great extent, so that the control over the furnace charge distribution is also limited in these apparatuses.

FIG. 3 shows another example of a conventional apparatus. A base 17 is attached to the foremost end of a horizontal push rod 16, and an inclined plate 18 is fastened to the base 17 at an appropriate angle. The base 17 is supported on rollers 20 which roll on a bracket 19. The rear end of the horizontal push rod 16 is connected to driving means (not shown) that causes the horizontal push rod 16 to move back and forth. This apparatus controls the charge distribution in the furnace by changing the position of the plates 18. Since the inclination of the plates 18 is fixed, this type of apparatus cannot change or adjust the charge distribution over a very wide area of the furnace.

British Pat. No. 1,177,333 discloses yet another type of charge distribution changing apparatus. This apparatus changes the furnace charge distribution by means of a large number of vertical plate segments which are supported by link mechanisms for horizontal and radial movement within the furnace. Because only the position, and not the inclination, of the segments is adjustable, this apparatus also is incapable of controlling the furnace charge distribution over a wide area. Moreover, the plate segment drive mechanism, each comprising the combination of a link mechanism and a bell crank, are complex.

OBJECTS AND BRIEF SUMMARY OF THE INVENTION

The apparatus of this invention is for the purpose of solving the above problems connected with the conventional blast furnace charge distribution changing apparatus.

An object of this invention is to provide an apparatus for changing the charge distribution in a blast furnace that is capable of controlling the furnace change distribution over a wide area.

Another object of this invention is to provide an apparatus for changing the charge distribution in a blast furnace that has a simple mechanism which has good durability and is easy to maintain.

In order to achieve the aforementioned objects, the apparatus for changing the charge distribution in a blast furnace according to this invention comprises a large number of arms disposed in a circle within the top of the furnace, a link pivotally connecting the upper end of each arm to the shell of the furnace so the arm is tiltable thereto, a plate fixed to the lower portion of the arm facing toward the center of the furnace, and means for inclining the arm with respect to the central vertical axis of the furnace and including a push rod having the foremost end pivotally connected to the lower portion of the arm for pushing it toward the center of the furnace and means for driving the push rod linearly.

In the blast furnace charge distribution changing apparatus of this invention, the link, the arm and the push rod together constitute a link mechanism, in which the linear motion of the push rod lengths and contracts the length of the paired link and arm, and when the paired link and arm lengthen, the pivot point of the upper end of the arm moves downwardly and slightly toward the wall of the shell. This causes, the plate to become more inclined the further it is moved toward the center of the furnace, as compared to the prior art devices in which the arm is pivoted directly on the furnaces structures. This permits directing the button (raw materials) to the center of the furnace without increasing the stroke of the push rod. During this inward travel, the lower end of the plate moves horizontally. Further, the plate is inclined only slightly in the early stage of the stroke. Therefore it insures a good charge distribution in the circumferential area of the furnace too. The apparatus of this invention employs short component parts which can be kept out of the rapid gas stream inside the furnace, so that their erosion or wear can be reduced. All component parts are so compact that they can be installed and replaced with ease. The straight linear motion of the push rod facilitates the provision of dust sealing means to prevent the infiltration of dust into the drive means of the apparatus. Elimination of moving parts on the outside of the furnace ensures the safety of the operators. Finally, the simplicity and compactness of this apparatus leads to weight reduction.

BRIEF DESCRIPTION OF THE DRAWINGS

The invention will now be described in greater detail with reference to the accompanying drawings, in which.

DETAILED DESCRIPTION OF THE PREFERRED EMBODIMENTS

Figure 1:
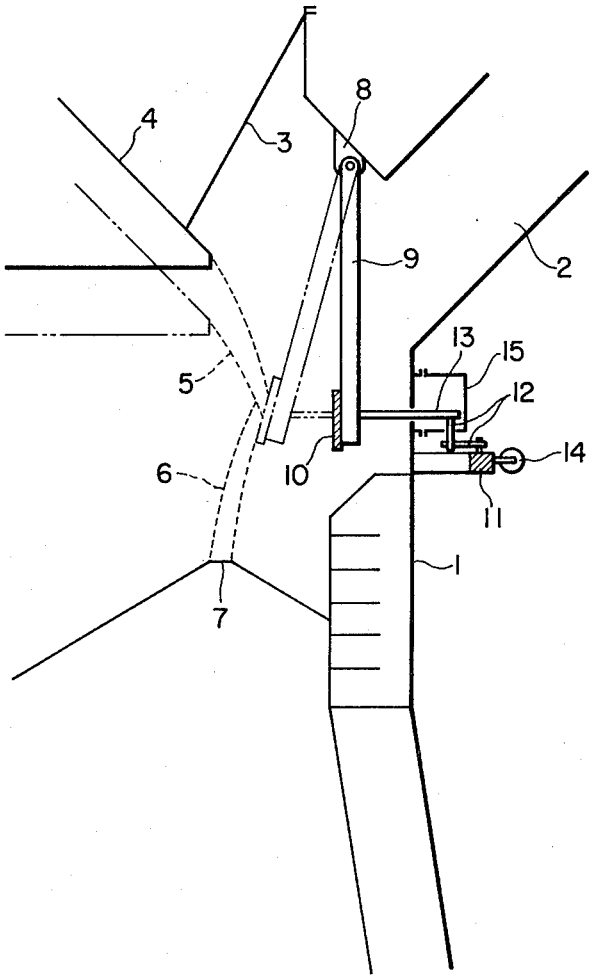
FIG. 1 PRIOR ART
FIG. 1 is a partial vertical cross-section showing an example of a conventional blast-furnace charge distribution changing apparatus.
Figure 2:
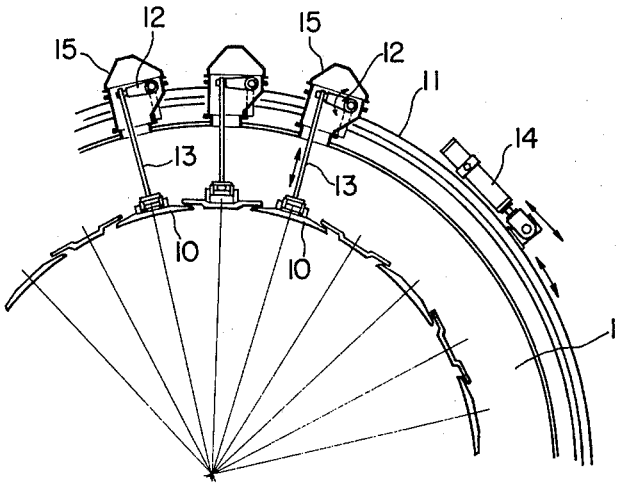
FIG. 2 PRIOR ART
FIG. 2 is a plan view of the apparatus of FIG. 1.
Figure 3:
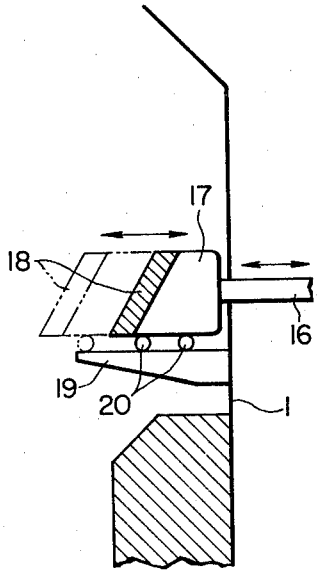
FIG. 3 PRIOR ART
FIG. 3 is a partial cross-section showing another example of a conventional blast-furnace charge distribution changing apparatus.
Figure 4:
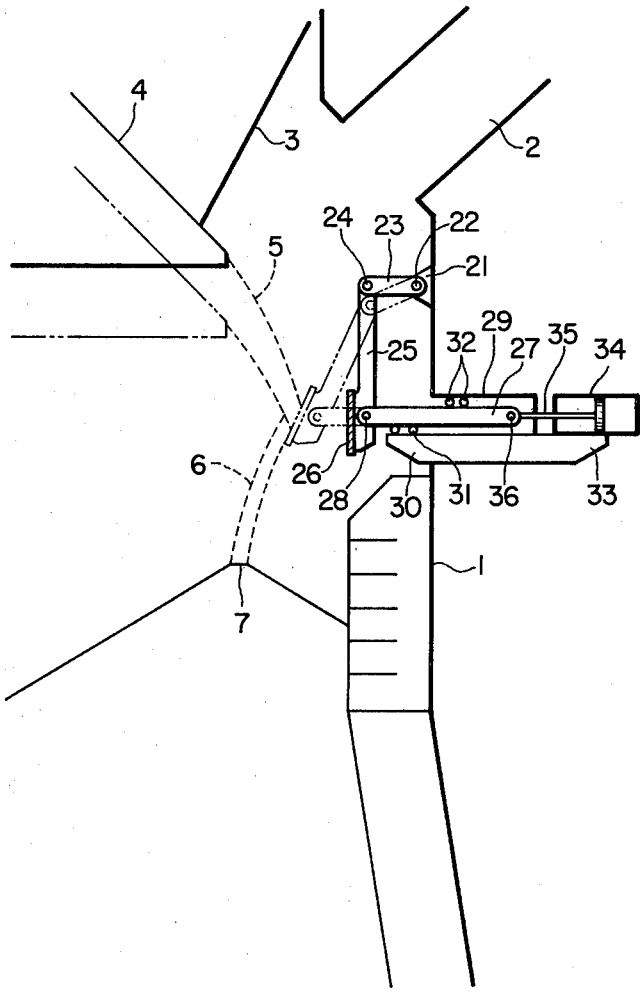
FIG. 4 is a partial cross-sectional view of a blast-furnace charge distribution changing apparatus according to the present invention.
Figure 5:
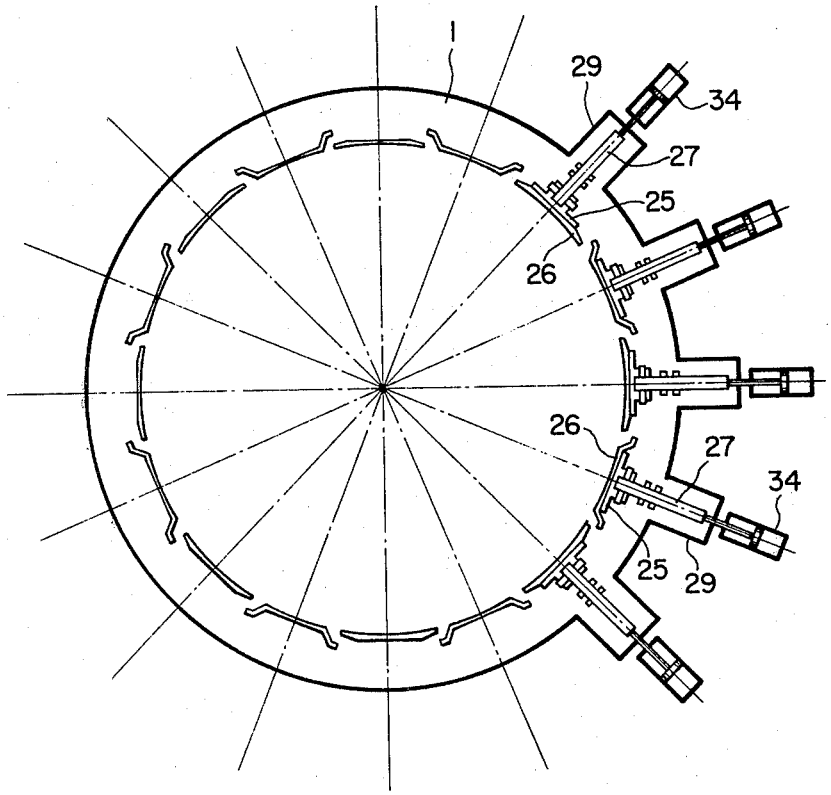
FIG. 5 is a plan view of the apparatus shown in FIG. 4.

As shown in FIGS. 4 and 5, a plurality of assemblies are positioned in a circle around the inside of the top of a blast furnace. Each assembly comprises a metal hanger 21 fastened to the furnace shell 1, below the gas uptake 2. A link 23 is pivotally connected to the metal hanger 21 by a pin 22. The upper end of an arm 25 is pivotablly attached to the free end of the link 23 by a pin 24. A plate 26 of a material such as armor plate, is fastened to that side of the lower portion of the arm 25 which is toward the center of the furnace.

The foremost end of a push rod 27 is pivotally connected by a pin 28 to the lower portion of the arm 25. The push rod 27 extends in the radial direction of the furnace shell 1, with the rear half thereof being contained in a casing 29 projecting outside the shell 1. A bracket 30 projecting inside the shell 1 and the casing 29 respectively carry rollers 31 and 32 on which the push rod 27 is horizontally carried 32. The link 23, arm 25 and push rod 27 make up a link mechanism. When the plate 26 is in the withdrawn standby position, the link 23 is in a substantially horizontal position and the arm 25 in a substantially vertical position.

A further bracket 33 projects outside the shell 1 and has a hydraulic piston-cylinder device 34 mounted thereon. The piston rod 35 of the hydraulic piston-cylinder device 34 extends horizontally through the casing 29, the opening through which the rod 35 passes being sealed by a packing to prevent the furnace gas from leaking out around the rod 35. The rod is pivotally connected to the rear end of the push rod by a pin 36.

The assemblies, each comprising the link 23, arm 25, push rod 27 and hydraulic cylinder 34, are arranged in a circle in the furnace shell so that the edges of each plate 26 overlap the edges of the adjacent plates 26.

The operation of the above-described blast-furnace charge distribution changing apparatus according to this invention is as follows. In order to direct the charge falling from a large bell hopper 3 as a large bell 4 descends toward the center of the furnace, the hydraulic cylinder 34 is driven to push the plate 26 inward. At this time, the push rod 27 moves horizontally, the link 23 rotates counterclockwise (in FIG. 4) about the pin 22, and the arm 25 rotates clockwise about the pin 24. Consequently, the link 23 and arm 25, connected by the pin 24 tend to straighten out and become more aligned with each other, the overall length increasing, and the pivot point of the upper end of the arm 25 moves downwardly and slightly outwardly toward the shell. The combined rotary motions of the link 23 and arm 25 as the push rod 27 moves horizontally in turn inclines the arm 25 to the position as shown by the dotted lines. The further the push rod 27 moves toward the center of the shell the greater the inclination of the plate 26, and this inclination is greater than would be the inclination if the arm 25 were pivoted above the gas uptake 2. The charge from the large bell 4 falls against and is deflected by the armor plate 26 and then falls to the desired position 7 along trajectories 5 and 6.

The push rod 27 is not limited to the one in the above-described embodiment which moves horizontally. It may move along a slightly slanted line. The drive means for the plate 26 likewise is not limited to the above described means but may comprise a combination of a link mechanism, a bell crank lever, an electric motor, a hydraulic motor, etc., as long as it reciprocates the plate 26 linearly. In all cases, it must be insured that the member passing through the gas-sealed casing 29 does not move vertically or laterally. The position of the link 23 when the arm 25 is in the vertical position need not be exactly horizontal. The relationship between the stroke of the push rod 27 and the inclination of the plate 26 depends on the position of the arm 25 and link 23 when they are in the standby position, their lengths, and the ratio of their lengths, which must be appropriately selected to obtain the desired charge distribution in the blast furnace. Finally an arm supporting structure other than the link 23 can be used, provided that it moves the pivot point of the upper end of arm 25 downwardly and slightly outwardly when the plate 26 is moved inwardly.

What I claim is:

1. An apparatus for changing the charge distribution in a blast furnace, comprising:

a plurality of arms disposed in a circle within the top of the furnace and extending generally vertically;

a plate mounted on the bottom of each arm facing toward the center of the furnace in the path of the trajectory of the charge flowing into the furnace for being struck by the charge and deflected into the lower portion of the furnace;

push rod means to which the lower end of each said arm is pivotally connected, each said push rod means being movable for moving the lower end of the corresponding arm toward and away from the center of the furnace along a substantially horizontal line;

drive means connected to each said push rod means for moving said push rod means toward and away from the center of the furnace; and means mounting the upper end of each arm for swinging movement downwardly along an arc away from the center of the furnace and slightly outwardly toward the periphery of the furnace by the movement of the lower end of each said arm toward the center of the furnace by said push rod means, whereby the plate is tilted so as to move the upper edge away from the center of the furnace the closer each plate is moved toward the center of the furnace.

2. An apparatus as claimed in claim 1 in which said mounting means comprises a link having one end pivotally mounted on the blast furnace and having the upper end of said arm pivotally connected to the other end thereof.

3. An apparatus as claimed in claim 2 in which said blast furnace has a gas uptake in the upper end thereof, and said link is pivoted to the furnace below said gas uptake, and when said arm is in the most retracted position, said link is substantially horizontal.

4. An apparatus as claimed in claim 1 in which said push rod means comprises a push rod and rollers mounted on said furnace for supporting and guiding said push rod during its movement toward and away from the center of the furnace.

* * * * *